United States Patent [19]

Proefrock

[11] 4,083,212

[45] Apr. 11, 1978

[54] ROTARY DISC TUMBLER CYLINDER LOCK

[75] Inventor: Paul R. Proefrock, Nicholasville, Ky.

[73] Assignee: Sargent & Greenleaf, Inc., Nicholasville, Ky.

[21] Appl. No.: 797,532

[22] Filed: May 16, 1977

[51] Int. Cl.[2] ..... E05B 29/02

[52] U.S. Cl. ..... 70/366; 70/417; 70/422

[58] Field of Search ..... 70/364 R, 365, 366, 70/374, 376, 377, 417, 422

[56] References Cited

U.S. PATENT DOCUMENTS

| | | | |
|---|---|---|---|
| 2,832,211 | 4/1958 | Saarento | 70/364 R |
| 3,681,956 | 8/1972 | Niilola | 70/366 |
| 3,699,790 | 10/1972 | Ansala | 70/364 R |
| 4,008,588 | 2/1977 | Miller | 70/366 |

*Primary Examiner*—Robert L. Wolfe

*Attorney, Agent, or Firm*—Mason, Fenwick & Lawrence

[57] ABSTRACT

A key-operated rotary plug cylinder lock having rotary disc tumblers arranged in a stack with a concentric cylindrical boss on one face of each disc tumbler projecting axially into internesting relation into a complimental cylindrical well or recess in the confronting face of the next adjacent tumbler, and having center openings in the rotary disc tumblers shaped to receive a cylindrical guide pin along the center axis of the stack of tumblers and an arcuate substantially semi-circular cross section bit portion of a key. A set screw is threaded into the rear wall of the plug assembly to adjust the axial position of the guide pin and reduce the clearance between tumblers made to normal manufacturing tolerances to insure that the space between adjacent tumblers always assumes a labyrinth configuration resisting passing of a combination reading probe or picking tool therebetween and provides proper spacing for engagement with key bits. A frangible fence in the form of a bar having two relatively thin frangible fence portions extending into section peripheral recesses in the disc tumblers is subject to destruction upon attempts to torque the cylinder and thus render the cylinder inoperable, still in the locked condition.

20 Claims, 5 Drawing Figures

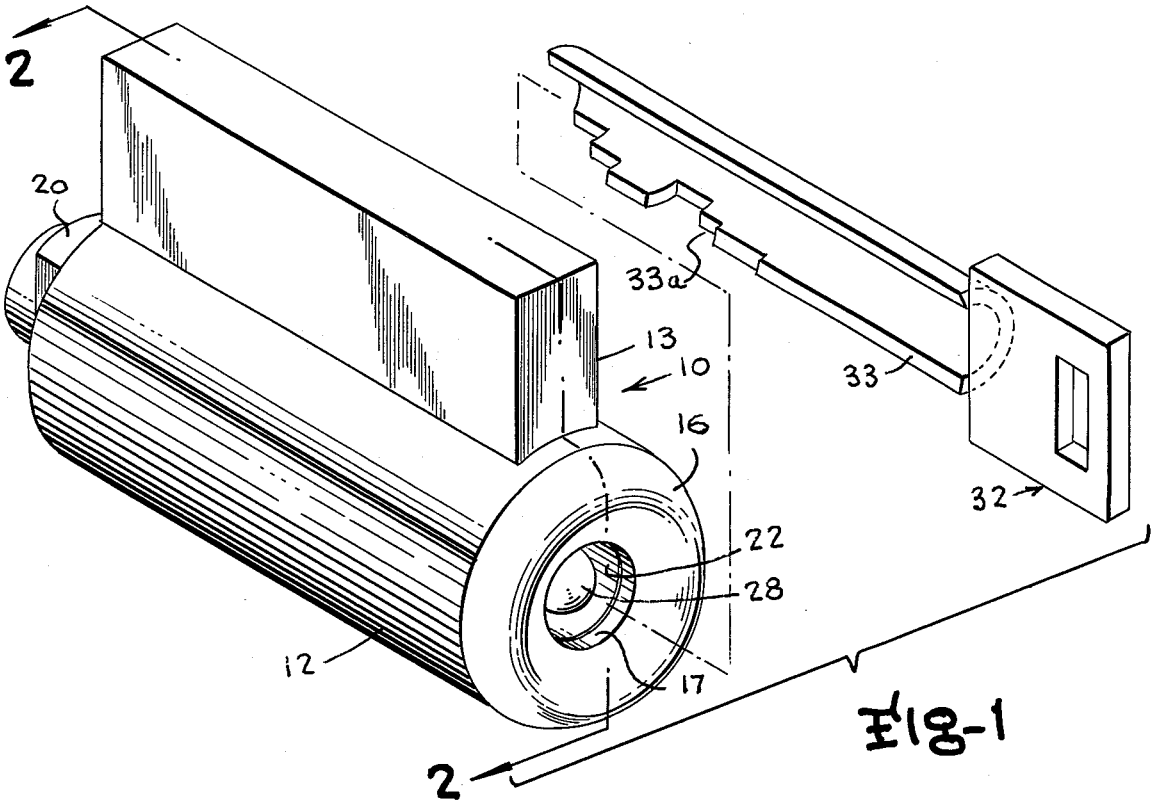
Fig-1
Fig-4
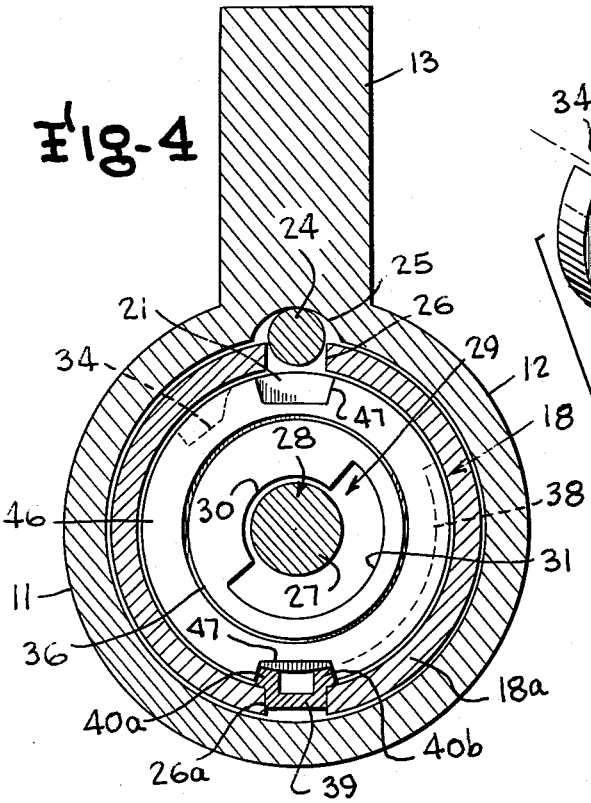
Fig-5
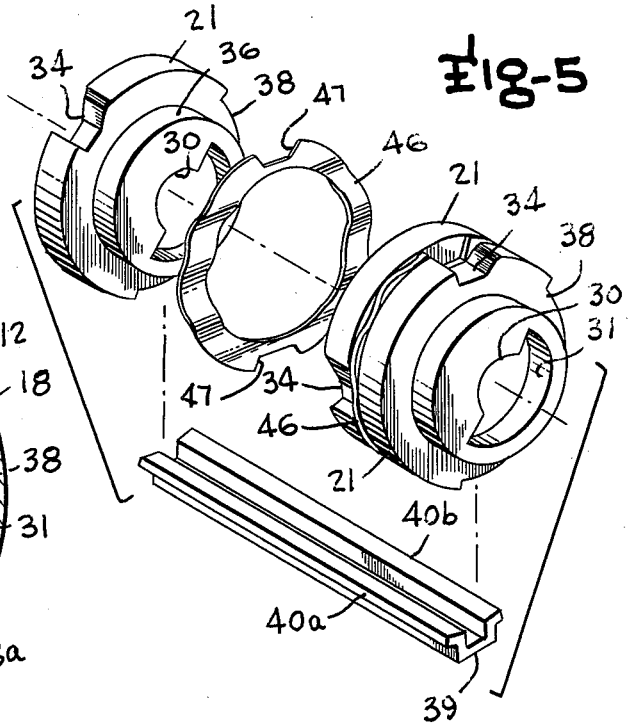

Fig-2
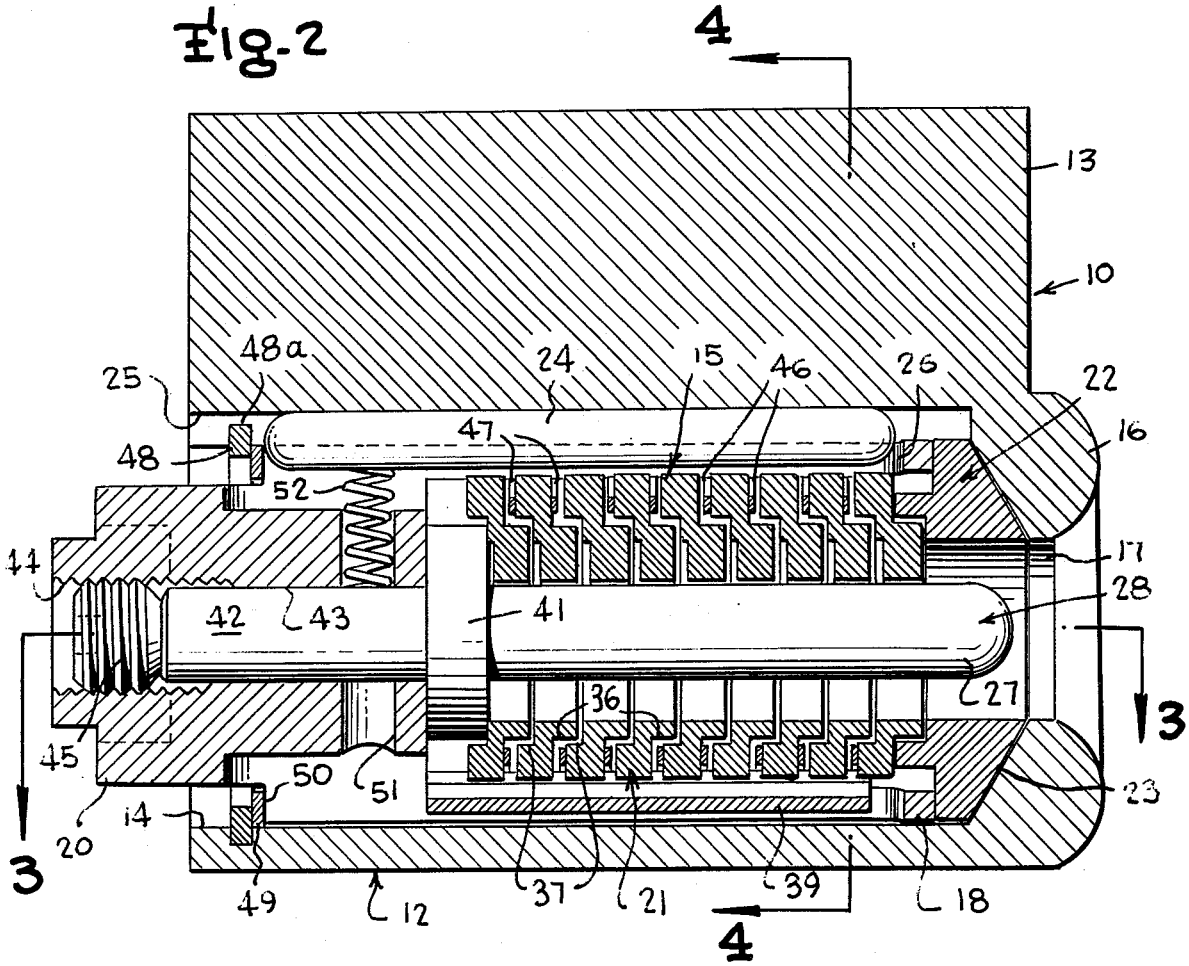
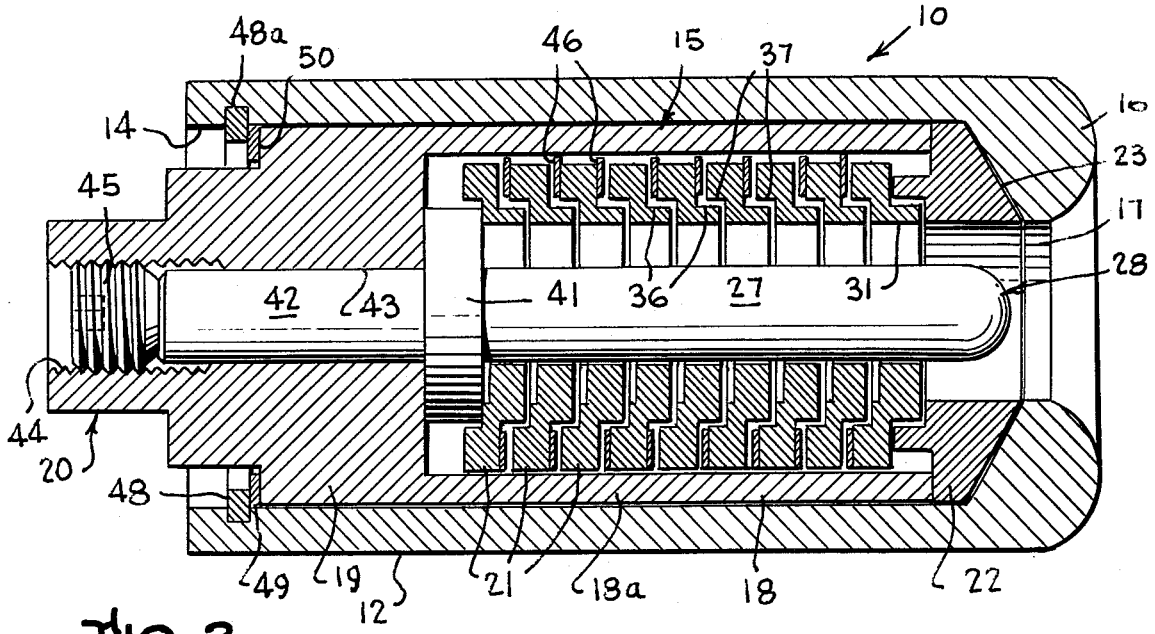
Fig-3

ROTARY DISC TUMBLER CYLINDER LOCK

BACKGROUND AND OBJECTS OF THE INVENTION

The present invention relates in general to cylinder type key locks, and more particularly to key-operated rotary plug cylinder locks having rotary disc type tumblers and having special provisions for protecting the same against detection of the distinctive key contour or combination surface by picking probes or reading probes or the like and otherwise enhancing protection of the lock against unauthorized entry.

One of the common types of key locks which have come into wide use is the type known as a cylinder lock. Conventional cylinder locks normally comprise a relatively fixed housing forming the lock body or casing having a cylindrical bore opening through the front surface of the lock body which rotatably houses a rotating cylinder or plug assembly. The rotatable cylinder or plug assembly has a key way or key slot opening through the front surface of the cylinder or plug and extending over most of the axial length thereof, as well as one or more resiliently urged tumblers formed of rotatable or slidable members which normally occupy positions crossing the sheer zones or interfacial zones at boundaries between the rotatable cylinder or plug and the outer body or casing preventing rotation of the plug relative to the casing. When a key of proper contour or combination surface is inserted in the key way or key opening in the cylinder or plug, the contoured key surface aligns the resiliently urged tumblers in such a way that a parting line, either of the tumbler members or of some other locking member coactive with the tumbler members, is brought into coincidence with the interfacial plane or the arcuate peripheral surface of the plug at the sheer zone, so that when all of the resiliently urged tumblers are properly aligned by the contoured key surface, rotational force applied to the key permits the plug to turn through the normal motion involved in moving the lock from a locked to an unlocked condition.

Due to conditions which arise in the construction of the lock parts under normal manufacturing tolerances, it has been possible in cylinder locks which are not provided with special pick-resistant features, to achieve unauthorized operation of the lock by such picking techniques as inserting a picking tool into the keyway and exerting a torque on the plug so that with careful movement of the plug in selected directions, the resiliently urged tumbler first placed in compression by torquing the plug is aligned by the pick for clearance, at which point the plug rotates a minute degree to bring the next resiliently urged tumbler into similar compressed condition and it is then aligned by the pick for clearance, and this succession of operations is repeated until all the tumblers have been aligned to permit the plug or cylinder to be rotated.

One of the most common types of cylinder locks is the pin tumbler type cylinder lock, wherein segmented tumbler pins formed of lower key engaging pin segments and upper drive pin segments have a line of separation between the segments which is normally displaced from the sheer zone of the plug, but is positioned by the proper key so that the line of separation of all of the pin tumblers align with the plug sheer line and permits rotation of the plug. Such pin tumbler type cylinder locks have been particularly susceptible to the above described types of picking techniques, and many attempts have been made to provide them with resistance to such picking attack. In some cases, the pin tumblers have been so constructed that tampering by picking techniques applied to any one of the tumbler pins automatically locks the remaining tumblers against further movement, or additional recesses have been provided in the outer body or casing so that after a pin tumbler has been picked it re-engages in the absence of clearance of the remaining pin tumbler. Lock-out devices have also been provided so that attempts to pick one or more of the pin tumblers results in additional locking pins being activated to lock the plug against rotation even by authorized persons with a proper key.

To increase resistance to picking by the techniques which are successful with pin tumbler type cylinder locks, cylinder locks of the rotary disc tumbler type have come into wider use. A popular type of rotary disc tumbler cylinder lock is the so-called Abloy lock, wherein a bank of peripherally gated rotary locking discs housed within a rotatable sleeve member have shaped center apertures which respond to a proper key contour surface to align the gates to permit radially inward movement of the locking bar which normally traverses the sheer line between the rotary plug portion and an outer fixed casing of the lock. Such rotary disc tumbler type cylinder locks may be of the general type disclosed in U.S. Pat. Nos. 3,771,340 or 3,848,442 or 3,972,210, with or without related features of other patents obtained by the Finnish corporation Oy Wartsila AB relating to the Abloy lock. Unauthorized detection of the key code or key combination of key-operated cylinder locks of this rotary disc tumbler type has been achieved, however, by techniques such as introducing a picking probe or reading tool into the key opening to interpose an offset shaped extension or feeler thereof between the faces of successive rotary disc tumblers and manipulating the probe or reading tool to detect the position of the peripheral gates on the disc tumblers, signifying the key or combination code, and by observing the angular position of the probe externally of the lock and determining therefrom the key combination of shaped surface contour of the key for that lock. Also, techniques of torquing the cylinder or plug of such locks in a special manner to distort metal from some of the lock components into normally vacant spaces within the lock by application of strong torquing forces to the cylinder or plug have resulted in unauthorized penetration of the lock.

It has been proposed in U.S. patent application Ser. No. 681,241 filed Apr. 28, 1976 by Harry C. Miller et al to specially construct locks of this rotary disc tumbler type so as to provide barriers resisting radially outward movement of the feeler of such a probe or reading tool through the space between adjacent rotary disc tumblers to the zone of the peripheral gates by providing a barrier to penetration of the feeler of such a probe between each of the rotary disc cylinders, as by shaping the confronting faces of adjacent rotary disc tumblers to provide a labyrinth-type passage therebetween. While such a lock, if the rotary disc tumblers are carefully constructed to very close tolerances, may provide effective protection against unauthorized detection of the lock combination or key contour by such reading probe techniques, it is difficult to maintain the space between adjacent tumblers at such small dimensions that effective probe penetration is resisted when the rotary disc tumblers are made to customary manufacturing tolerances.

An object of the present invention, therefore, is the provision of a novel rotary plug cylinder lock having rotary disc type tumblers constructed in a special manner to provide labyrinth-type passages between adjacent tumblers for resisting unauthorized detection of the key combination by reading probe techniques and the like, wherein means are provided for adjusting the spacing between successive disc tumblers in assembled stacks of tumblers in the lock to small dimensions by means of an adjusting set screw to control the labyrinth spacing between successive adjacent disc tumblers and to control spacing of the disc tumblers relative to the key bit positions to improve reliability and performance of the lock.

Another object of the present invention is the provision of a novel rotary plug lock of the rotary disc tumbler type as described in the immediately preceding paragraph, wherein wavy shaped spacers or washers are provided between successive disc tumblers resiliently biasing them to a predetermined spacing between successive disc tumblers, and wherein the set screw adjusting means applies compressive force to the stack of disc tumblers to reduce or control the spacing between successive tumblers, to enable reliable operation and high security performance in dirty environments and avoid dirt-interference operation of adjacent disc tumblers by dirt penetrating intertumbler spaces.

Another object of the present invention is the provision of a novel rotary plug lock of the type described in either of the two immediately preceding paragraphs, wherein an elongated cylindrical guide pin extends forwardly from the rear of the lock to the key entrance thereof along the center axis of the stack of rotary disc tumblers substantially filling an opening therefor and providing a keyway of arcuately curved substantially semi-circular cross-sectional configuration surrounding a portion of the periphery of the guide pin, and wherein the guide pin bears forwardly against the rearmost disc tumbler of the stack and is adjustable axially for adjusting the spaces between successive tumblers.

Yet another object of the present invention is the provision of a rotary plug lock of the type described in the preceding paragraphs, wherein a frangible fence means is provided in an economical manner having two circumferentially spaced thin frangible stop ribs to protect between the sleeve portion of the plug surrounding the stack of rotary disc tumblers and into sector recesses in the periphery of the disc tumblers to readily destruct upon torquing of the plug beyond a certain torque threshold and render the plug inoperable and in locked condition, and yet which does not accidentally destruct or become damaged under normal operation.

Other objects, advantages and capabilities of the present invention will become apparent from the following detailed description, taken in conjunction with the accompanying drawings illustrating a preferred embodiment of the invention.

BRIEF DESCRIPTION OF THE FIGS.

FIG. 1 is a perspective view of a rotary plug lock of the rotary disc cylinder type and a typical key therefor, constructed in accordance with the present invention;

FIG. 2 is a vertical longitudinal section view of the lock, taken along the line 2—2 of FIG. 1;

FIG. 3 is a horizontal longitudinal section view of the lock, taken along a section plane perpendicular to the section plane of FIG. 2;

FIG. 4 is a vertical transverse section view of the lock, taken along the line 4—4 of FIG. 2;

FIG. 5 is a fragmentary exploded perspective view of a portion of the frangible fence or stop bar and a plurality of the associated rotatable disc tumblers making up the tumbler stack.

DETAILED DESCRIPTION OF A PREFERRED EMBODIMENT

Referring to the drawings, wherein like reference characters designate corresponding parts throughout the several figures, the key-operated cylinder lock of the present invention is indicated generally by the reference character 10 and comprises a main body or lock housing 11 having a generally cylindrical hollow shell portion 12 and in the illustrated version, includes an optional extension portion 13 resembling the usual top extension of pin tumbler type lock bodies which customarily house the springs and the upper segments of the pins. Of course, this extension may be eliminated entirely or may take other configurations depending on application. The cylindrical hollow shell portion 12 has a rearwardly opening cylindrical bore 14 formed therein which houses a rotatable cylinder or plug assembly 15. The cylindrical shell portion 12 of the main lock body includes an annular front wall portion 16 having a circular key opening or entrance 17 therein defining the entrance to the keyway of the plug assembly 15 with the annular front wall portion 16 being rounded to provide an outwardly or forwardly convex circular or ring shaped bead formation as illustrated in the drawings, in the illustrated example. The rotatable plug assembly 13 is basically formed of a forwardly opening, generally cup shaped cylindrical sleeve member 18 having an annular sleeve portion 18a of uniform diameter from the forwardmost end thereof to an integral, centrally apertured rear wall formation 19 having a smaller diameter rear extension 20, and encloses a stack of rotatable locking disc tumblers 21 arranged in a stacked array concentric with the center axis of the cylindrical sleeve portion 18a of the plug assembly. Interposed between the forwardmost end of the cylindrical sleeve 18 and the annular front wall portion 16 of the main body 11 is a carbide thrust washer 22 of generally annular or ring shaped configuration having an outer diameter corresponding to the diameter of the cylindrical bore 14 and an inner diameter corresponding to the diameter of the key opening 17, with its front face 23, here shown to have a tapered conical configuration, shaped to conform to and butt against the rearwardly facing surface of the annular front wall 16 and having an annular rearwardly projecting rib 24 to butt against and form a stop for the forwardmost disc tumbler 21 of the tumbler stack. The thrust washer is formed of hardened tool steel or carbide steel designed to resist drilling through the front wall portion of the lock housing into the bore 14 to penetrate the bore and achieve unauthorized operation or penetration of the lock. The cylinder lock body or housing 11 may be provided with mounting wings or enlargements adjacent the front of the lock body having screw holes for mounting the lock casing in the door, closure or mounting wall or may be secured thereto in any other conventional manner, and a connecting bar or other coupling may be fixed to the rear extension 20 of the rotatable plug assembly or cylinder 15 in the usual manner, as by a set screw fixation, or providing a flat or recess formation at some point on the periphery of the rear extension coacting with a similarly shaped opening in a rotatable bolt or locking bar, to achieve locking and unlocking of the closure or other structure to be secured by the lock when the cylinder lock plug assembly is rotated between locked and unlocked positions upon insertion of a proper key.

In the normal condition of the lock without the proper key being inserted, the cylindrical sleeve portion 18 of the rotatable plug assembly 15 is fixed against rotation relative to the cylindrical shell portion 12 of the lock body 11 by means of an elongated locking bar 24 extending parallel to the axis of the plug assembly 15 and positioned so that it is partially located in an axially extending groove 25, here shown to be of concave, substantially semi-cylindrical cross-sectional configuration, provided in the inwardly facing surface of the cylindrical shell portion 12 of the lock body 11 and partially in an axially extending elongated slot 26 extending through the annular cylindrical sleeve portion of the sleeve member 18, so as to span the sheer zone or sheer line between them. The rotary locking discs or disc tumblers 21 is the described embodiment are designed to be assembled onto a relatively small diameter forwardly projecting cylindrical rod formation 27 of a guide pin member 28, and to this end are provided with a specially shaped center opening 29 having a first smaller diameter semi-circular opening portion 30 substantially conforming to the diameter of the rod portion 27 of the guide pin 28 and having a larger diameter substantially semi-circular opening portion 31 which is slightly greater in circumference than a semi-circle, in the illustrated embodiment, extending in the opposite direction from the center axis of the associated tumbler relative to the smaller diameter portion 30. It will thus be seen, from inspection of the cross-sectional illustration in FIG. 3, that when the disc tumblers 21 are assembled on the rod formation 27 of the guide pin 28 and the rod formation fills the circular center thereof including the smaller diameter opening portion 30, a keyway or arcuate cross-sectional configuration outwardly encircling slightly more than half the circumference of the guide pin is defined to receive a key 32 having a bit 33 of similar cross-sectional configuration. The bits of keys designed to operate the lock are cut in accordance with a predetermined key coding to provide a combination surface, indicated at 33a, preferably having combination values at various incremental step angles. For example, in the previously identified Oy Wartsila U.S. patents, the bit cuts are spaced angularly or circumferentially about 18° apart and the peripheral portions of the rotary locking disc tumblers 21 are provided with one or more outwardly peripheral gates or recesses 34 disposed in a predetermined angular relation so that they will be radially aligned with the axial slot 26, groove 25 and locking bar 24 when the appropriate key is inserted in the substantially semi-circular arcuate keyway and is rotated through an appropriate angle in the proper direction. When the proper key is inserted and rotated, the aligned tumbler gates 34 form a groove aligned with the locking bar 24 to receive the locking bar and the locking bar is cammed radially inwardly to nest in the gates 34 and slot 26 when a torque is transmitted to the plug sleeve member 18 by turning of the key further in the same direction, due to the curvature of the sides of the substantially semi-cylindrical axial groove 25 in the shell portion 12 of the lock body.

In this lock cylinder, the disc tumblers are designed for key bit cuts which are spaced angularly 20° apart, providing six different cuts in a 100° sector which yields a larger combination than the five cuts at 18° apart, enables a larger cross section on the key thus increasing its strength, and utilizing material and space in a more efficient manner.

Most of the locking disc tumblers 21 are rotatable between a zero position in which the insertion and removal of the key is possible and an angularly displaced position, called a release position, in which the tumbler gates 34 are lined up to receive the locking bar 24. The location of the tumbler gates 34 in the locking discs or tumblers 21 determines the combination value of each locking disc, as this is the angle the disc has to be turned from its zero position to its release position by the key to achieve unlocking of the lock. The operating key, as shown at 32, is provided with a contoured or combination surface 32*a* for each locking disc so that when the key is turned, its combination surfaces 33*a* engage the shoulder defined at one end of the larger diameter opening portion 31 of the respective tumblers and rotate each of the locking discs through the proper angle so that the tumbler gates 34 are brought into releasing position aligned with the locking bar 24. In the embodiment shown, for example, the combination surfaces 33*a* may be cut at stepped angles spaced 20° apart, for example, providing combination surfaces on the key of 0°, 20°, 40°, 60°, 80° or 100°. One of the locking discs or tumblers 21, known as the opening tumbler, has a turning angle of 100° so that at this point, it contacts the frangible fence 39 to transmit the torque from the key to the plug, so that when the key reaches the 100° position, all of the gates are disposed in releasing position aligned with the locking bar 24 if the correct key has been inserted. This enables a single tumbler to be used as the "opening tumbler" which forces the sleeve 18 to rotate if all of the tumbler gates have been properly aligned by the key to receive the locking bar 24 at the 100° position. Also, this "opening tumbler" can be located anywhere in the stack of disc tumblers and provides that all disc tumblers or wafers are effective and no "known reference point" disc tumblers or wafers are available to serve as reference points to aid in unauthorized "manipulation"or picking of the lock. In the Oy Wartsila lock, the first and last disc tumblers or wafers are required as "opening tumblers"for actuating the lock and thus produce a known reference point for aiding unauthorized persons in manipulating the lock.

The rotary locking disc tumblers 21 of the illustrated embodiment are especially shaped to prevent detection of the key code by insertion of a detecting probe or reading probe into the keyway formed by the part of the tumbler opening portion 31 outwardly surrounding the rod formation 27 of the guide pin 28 in a manner wherein a feeler portion of the probe may extend radially outwardly between the adjacent pair of the disc tumblers to the region where the tumbler gates 34 occur to feel the angular positions of the tumbler gates. This is achieved by shaping each tumbler disc to provide a barrier to insertion of a probe portion radially outwardly from the keyway through the spaces between tumblers, thus producing what I refer to as a labyrinth space between tumblers having an axially offset barrier portion. Each locking disc tumbler 21 is shaped to provide a forwardly projecting cylindrical boss or circular offset formation 36 sized to nest into a correspondingly shaped well or recess 37 in the confronting face of the adjacent locking disc tumbler 21. The forwardly projecting boss or circular offset formation 36 and well or recess 37 are of greater axial length or dimension than the axial length of the space between successive adjacent locking disc tumblers 21, so that an offset or labyrinth type space is defined between each adjacent pair of disc tumblers, and the circumscribing cylindrical side wall of the internesting recess or well 37 in the rearwardly facing surface of each disc tumbler 21 serves as a barrier against insertion of a probe portion in a radial direction in a plane perpendicular to the axis of rotation of the plug to the zone occupied by the peripheral gates 34 of the tumblers.

Also, instead of providing an outwardly projecting radial stop projection on each of the disc tumblers interfitting into a 90° sector recess in the plug sleeve member 18, as illustrated in most of the previously cited Oy Wartsila patents, the peripheral portions of the disc tumblers 21 are provided with a circumferentially elongated sector recess, for example, a 130° sector recess, as illustrated at 38 in the drawings, to cooperate with a stop member or frangible fence, indicated by the reference character 39, having, in the illustrated embodiment, a pair of frangible rib or thin fence formations 40*a*, 40*b* extending into the sector recesses 38 of the disc tumblers 21 making up the stack of disc tumblers, deliberately formed to be sufficiently thin and breakable so that the frangible rib or fence formations 40*a*, 40*b* will shear if the locking disc tumblers 21 are torqued with a force exceeding a preselected value before sufficient force is applied to shear the locking bar or distort it or adjacent portions of the locking discs into normally unoccupied spaces in the lock mechanism which would permit the plug assembly to be forcibly rotated by a torquing tool to permit penetration of the lock. This is provided to disable the lock against unauthorized penetration by torque forcing techniques, as shearing of the frangible rib or fence formations 40*a*, 40*b* permits all of the locking disc tumblers to freely rotate with the torquing tool as a pack, so that their gates remain out of alignment with each other and thus prevent alignment of their peripheral gates in a manner which would permit the locking bar 24 to move inwardly to the release position for the plug assembly.

As will be noted from the drawings, the relatively small diameter forwardly extending rod formation 27 of the guide pin 28 extends concentric with the center axis of the keyway defined by the stack of disc tumblers 21 to substantially the front plane of the forwardmost disc tumbler 21, and includes an enlarged, larger diameter intermediate collar formation 41 which conforms substantially to the diameter of the circular offset cylindrical formations of the tumblers to nest in the well 37 of the rearmost tumbler 21 and form a stop or abutment member bearing against the rearmost disc tumbler of the stack to urge the stack of tumblers against the rearwardly projecting annular rib 23*a* of the carbide thrust washer 22 to compress the stack of disc tumblers to a desired spacing relative to each other. The guide pin 28 also includes a rearwardly projecting rod portion 42 extending from the larger diameter collar formation 41 through a circular cross section bore 43 extending rearwardly concentrically along the center axis of the rear wall formation 19 and rear extension 20 of the sleeve member 18 and terminating in a slightly larger diameter rearwardly opening socket formation 44 provided in the rear extension 20 which is internally threaded to receive a flat point set screw 45 for adjusting the axial position of the guide pin 27.

Interposed between each successive pair of the rotary locking disc tumblers 21 is an annular waved spacer or washer 46 of spring metal, in the form of an annular ring having an outer diameter corresponding substantially to the outer diameter of the disc tumblers 21 provided with a pair of diametrically opposite gates or notches 47 therein, one of which is of a depth corresponding to the depth of the peripheral gates 34 in the disc tumblers 21 to be aligned with the locking bar 24 so that the locking bar will be accommodated in the release position when all of the tumbler gates are aligned, and the other of which is of a circumferential dimension and depth to receive the two frangible fence or rib formations 40*a*, 40*b* of the frangible stop member 39 therein. The waved spacers or washers 46 are preferably distorted to a generally sinusoidal waved configuration as illustrated in FIG. 5, providing three or four waves generally curving about axes which parallel a chosen diametric axis of the spacer 46, for example, the diametric axis passing through the two gates or notches 47, so that when positioned between the respective pairs of disc tumblers 21, they resiliently bias the disc tumblers away from each other a distance corresponding to the distance between the crests of the waved formations along the opposite surfaces thereof. Alternatively, the spring force desired between successive disc tumblers may be provided by cone-shaped Belleville type washers known in the trade.

It will be appreciated, therefore, that when the stack of disc tumblers 21 and washers or waved spacers 46 are assembled onto the guide pin 28 and inserted in the sleeve member 18, and this subassembly along with the frangible fence member 39 and locking bar 24 are installed in the bore 14 of the shell portion 12 of the main body, adjustment of the set screw 45 to urge the guide pin 27 forwardly will permit adjustment of the spacing between the respective pairs of disc tumblers 21. This rotary plug assembly consisting of the stack of rotary disc tumblers 21, cylindrical sleeve member 18, and guide pin 27 are assembled in appropriate position within the bore 14 of the main body shell portion 12 by a plural turn lock spring or similar snap ring type fastener 48 interfitting in an inwardly facing circular groove or channel 48*a* formed in the inwardly facing surface of the cylindrical bore 14. The snap ring fastener 48 bears a thrust washer 49 positioned against the rearwardly facing annular transition shoulder 50 of the cylindrical sleeve member 18 between the rear wall formation 19 and the smaller diameter rear extension 20 thereof. Thus, with the plug assembly formed of the array of rotary disc tumblers 21, sleeve member 18, guide pin 27, and locking bar and associated components assembled within the bore 14 by the spring fastener 48 and thrust washer 49, rotation of the flat point set screw 45 to force the guide pin 27 axially forwardly moves its enlarged collar 41 bearing against the rearmost of the locking disc tumblers 21 forwardly, relatively compressing the entire stack of disc tumblers 21 forwardly to compress the waved washer or spacer member 46, since the forwardmost disc tumbler 21 is held against forward movement by the rearwardly extending rib formation 23a of the front thrusher washer 22. This permits adjustment of the spacing between the successive disc tumblers 21 to insure that portions of each of the forwardly projecting boss formations 36 (except for the forwardmost disc tumbler) protrude to a desired extent into the rearwardly facing well formation 37 of the companion, forwardly adjacent disc tumbler, to be sure that a proper labyrinth passage is provided wherein the cylindrical boundary or transition surface between the well 37 of each disc tumbler and the rearwardly facing surface of the peripheral portion thereof provides an appropriate barrier against penetration of a reading probe portion into the gated peripheral zone of the disc tumblers. This also provides a labyrinth between disc tumblers which is designed so that compression of the disc tumbler and wafer and the washer stack will not provide an opening to receive any portion of the locking bar by which one might obtain a reference indication of the location of internal components or which might produce defective operation.

It will also be observed that, as a matter of manufacturing convenience, a hole 51 is drilled along a diametric axis through the slot 26 for the locking bar 24 and the slot 26a for the frangible fence 39 and through the rear wall portion 19 of the sleeve member 18 intersecting the bore for the rear portion 42 of the guide pin, and a coil spring 52 is interposed in the hole 51 with its bottom bearing against the rear portion 42 of the guide pin and its radially outermost portion bearing against the underside of the locking bar 24 to resiliently urge the locking bar 24 to the elevated position shown in FIG. 2.

What is claimed is:

1. A cylinder lock of the rotatable disc tumbler type comprising a stationary lock casing having a cylindrical bore therein, a rotatable plug assembly in the bore of said casing including a shell member rotatable in said bore and a plurality of locking disc tumblers encircled within said shell member arranged in a stack along a common axis therein and rotatable about said axis, an elongated locking bar disposed outwardly adjacent the peripheries of said disc tumblers spanning the stack of tumblers and normally restrained by the tumblers at a position for locking said shell member against rotation relative to the casing, the disc tumblers having gates alignable with and adapted to receive said locking bar to permit rotation of the shell member relative to the casing and said tumblers having key openings therein collectively defining a forwardly opening keyway and shaped to be engaged and angularly moved by the bit of a key inserted therein for aligning the gates with the locking bar, pick barrier means projecting across each intertumbler space between each adjacent pair or tumblers flanking such space including a formation defining a generally cylindrical barrier surface concentric with said common axis and projecting axially from one face of one of the tumblers of each adjacent pair in a first direction and the adjacent tumbler of the pair having a recess in the face thereof confronting said one face and shaped to receive the cylindrical barrier surface in nested relation therein, the barrier surface having an axial extent greater than the space between adjacent disc tumblers in the stacked array and being disposed at a location radially outwardly encircling the keyway to prevent insertion of picking tool portions between tumblers from the keyway into the gate regions thereof, spacer means between each successive pair of disc tumblers in the stack resiliently biasing the tumblers away from each other, means restraining the forwardmost disc tumbler at a position inwardly adjacent the front of the lock against movement toward the front, and forward thrust means movable axially of the stack and bearing against the rearmost disc tumbler of the stack and including a manually operable threaded adjustment portion for adjusting the thrust means and said rearmost disc tumbler toward the front of the lock to vary compressive forces on the stack in the direction of said common axis and thereby adjust the spacing between the disc tumblers thereof.

2. A cylinder lock as defined in claim 1, wherein said barrier surface provides a radially inwardly facing cylindrical shoulder spanning an axial distance at least as great as about twice the space between adjacent tumblers and located radially outwardly of the keyway and inwardly of the gate zone of the tumblers.

3. A cylindrical lock as defined in claim 1, wherein said disc tumblers each have a circumferentially elongated relieved sector in the periphery thereof receiving frangible rib means axially spanning the stack of tumblers and projecting radially inwardly from said shell member to align the key openings of the tumblers in proper positions for insertion and withdrawal of a key relative to the keyway, said rib means including a thin frangible rib member providing a pair of circumferentially spaced parallel frangible ribs designed to be sheared from the shell member when torque forces exceeding a predetermined threshold value are applied to the tumblers thereby leaving the tumblers distributed in locking position.

4. A cylinder lock as defined in claim 3, wherein said locking disc tumblers each have a cylindrical boss formation projecting axially of the plug assembly from a first face thereof in a first direction and having a cylindrical recess in the opposite face thereof conforming in size and shape to said boss providing said pick barrier means, the disc tumblers being arranged in an internesting stacked array with said boss formation received in nested relation in the recess of an immediately adjacent tumbler and said boss formations each having an axial extent greater than the space between adjacent disc tumblers in the stacked array forming a barrier across said intertumbler space at a location radially outwardly encircling the keyway.

5. A cylinder lock as defined in claim 4, wherein said disc tumblers are generally platelike discs having a front face and a rear face each having a flat circular center portion lying in a first transverse plane encircled by a flat annular outer rim portion lying in a second transverse plane offset axially of the tumbler from and paralleling the first transverse plane.

6. A cylinder lock as defined in claim 4, wherein said disc tumblers are generally circular platelike discs having a front face and a rear face each having a flat circular center portion lying in a first transverse plane encircled by a flat annular outer rim portion lying in a second transverse plane offset axially of the tumbler from and paralleling the first transverse plane by a distance approximating the thickness of the tumbler.

7. A cylinder lock as defined in claim 5, wherein cylindrical shoulders are formed by the side of said boss formation and by the side of said recess in each disc tumbler spanning an axial distance at least as great as the space between adjacent tumblers and located radially outwardly of the keyway and inwardly of the gate zone of the tumblers.

8. A cylinder lock as defined in claim 1, wherein said forward thrust means comprises an elongated guide pin having a cylindrical rod formation projecting along and concentric with said common axis through the center line of said stack of disc tumblers and having a collar formation rearwardly adjacent the rearmost disc tumbler bearing against the rearwardly facing surface thereof, and said threshold adjustment portion comprising a set screw threaded into an internally threaded bore in a portion of said shell member rearwardly of the stack of disc tumblers axially aligned with and bearing against the rearmost end of said guide pin for moving the guide pin forwardly of the stack to adjust the position thereof and thereby adjust the spacing between the disc tumblers forming the stack.

9. A cylinder lock as defined in claim 3, wherein said forward thrust means comprises an elongated guide pin having a cylindrical rod formation projecting along and concentric with said common axis through the center line of said stack of disc tumblers and having a collar formation rearwardly adjacent the rearmost disc tumbler bearing against the rearwardly facing surface thereof, and said threaded adjustment portion comprising a set screw threaded into an internally threaded bore in a portion of said shell member rearwardly of the stack of disc tumblers axially aligned with and bearing against the rearmost end of said guide pin for moving the guide pin forwardly of the stack to adjust the position thereof and thereby adjust the spacing between the disc tumblers forming the stack.

10. A cylinder lock as defined in claim 4, wherein said forward thrust means comprises an elongated guide pin having a cylindrical rod formation projecting along and concentric with said common axis through the center line of said stack of disc tumblers and having a collar formation rearwardly adjacent the rearmost disc tumbler bearing against the rearwardly facing surface thereof, and said threaded adjustment portion comprising a set screw threaded into an internally threaded bore in a portion of said shell member rearwardly of the stack of disc tumblers axially aligned with and bearing against the rearmost end of said guide pin for moving the guide pin forwardly of the stack to adjust the position thereof and thereby adjust the spacing between the disc tumblers forming the stack.

11. A cylinder lock as defined in claim 6, wherein said forward thrust means comprises an elongated guide pin having a cylindrical rod formation projecting along and concentric with said common axis through the center line of said stack of disc tumblers and having a collar formation rearwardly adjacent the rearmost disc tumbler bearing against the rearwardly facing surface thereof, and said threaded adjustment portion comprising a set screw threaded into an axially threaded bore in a portion of said shell member rearwardly of the stack of disc tumblers axially aligned with and bearing against the rearmost end of said guide pin for moving the guide pin forwardly of the stack to adjust the position thereof and thereby adjust the spacing between the disc tumblers forming the stack.

12. A cylinder lock as defined in claim 1, wherein said spacer means comprise annular spring metal washers interposed in the intertumbler spaces between adjacent pairs of disc tumblers, the annular washers being disposed in outwardly surrounding concentric relation to the cylindrical boss formation extending through the intertumbler space occupied by the respective washers and being located generally in parallel planes normal to said common axis, the washers having a waved cross-sectional configuration providing curved crest formations protruding from the center plane of each respective washer toward the front and rear of the stack of tumblers to bear against confronting faces of the tumblers.

13. A cylinder lock as defined in claim 3, wherein said spacer means comprise annular spring metal washers interposed in the intertumbler spaces between adjacent pairs of disc tumblers, the annular washers being disposed in outwardly surrounding concentric relation to the cylindrical boss formation extending through the intertumbler space occupied by the respective washers and being located generally in parallel planes normal to said common axis, the washers having a waved cross-sectional configuration providing curved crest formations protruding from the center plane of each respective washer toward the front and rear of the stack of tumblers to bear against confronting faces of the tumblers.

14. A cylinder lock as defined in claim 1, wherein said disc tumblers each have a circumferentially elongated relieved sector in the periphery thereof, and said shell member has an elongated narrow recess formed therein spanning the stack of disc tumblers and supporting a frangible rib member therein, the frangible rib member having a pair of parallel ribs projecting therefrom radially inwardly toward the stack of tumblers and spanning the stack along pairs paralleling said common axis providing a pair of circumferentially spaced thin frangible ribs projecting into said relieved sectors to align the key openings of the tumblers at proper positions for insertion and withdrawal of a key relative to the keyway and to be sheared from said shell member when torque forces exceeding a predetermined threshold value are applied to the tumblers.

15. A cylinder lock as defined in claim 14, wherein said frangible rib member is of channel shaped cross-sectional configuration having a base portion seated in the slot in said shell member and having channel side portions integral with the base portion forming said frangible ribs.

16. A cylinder lock as defined in claim 4, wherein said disc tumblers each have a circumferentially elongated relieved sector in the periphery thereof, and said shell member has an elongated narrow recess formed therein spanning the stack of disc tumblers and supporting the frangible rib member therein, the frangible rib member having a channel shaped cross section providing said pair of parallel ribs projecting therefrom radially inwardly toward the stack of tumblers and spanning the stack along paths paralleling said common axis providing a pair of circumferentially spaced thin frangible ribs projecting into said relieved sectors to align the key openings of the tumblers at proper positions for insertion and withdrawal of a key relative to the keyway and to be sheared from said shell member when torque forces exceeding a predetermined threshold value are applied to the tumblers.

17. A cylinder lock as defined in claim 16, wherein said frangible rib member of channel shaped cross-sectional configuration has a base portion seated in the slot in said shell member and having channel side portions integral with the base portion forming said frangible ribs.

18. A cylinder lock as defined in claim 8, wherein said disc tumblers each have a circumferentially elongated relieved sector in the periphery thereof, and said shell member has an elongated narrow recess formed therein spanning the stack of disc tumblers and supporting a frangible rib member therein, the frangible rib member having a pair of parallel ribs projecting therefrom radially inwardly toward the stack of tumblers and spanning the stack along pairs paralleling said common axis providing a pair of circumferentially spaced thin frangible ribs projecting into said relieved openings to align the key openings of the tumblers at proper positions for insertion and withdrawal of a key relative to the keyway and to be sheared from said shell member when torque forces exceeding a predetermined threshold value are applied to the tumblers.

19. A cylinder lock as defined in claim 18, wherein said frangible rib member is of channel shaped cross-sectional configuration having a base portion seated in the slot in said shell member and having channel side portions integral with the base portion forming said frangible ribs.

20. A cylinder lock as defined in claim 11, wherein said disc tumblers each have a circumferentially elongated relieved sector in the periphery thereof, and said shell member has an elongated narrow recess formed therein spanning the stack of disc tumblers and supporting a frangible rib member therein, the frangible rib member having a pair of parallel ribs projecting therefrom radially inwardly toward the stack of tumblers and spanning the stack along pairs paralleling said common axis providing a pair of circumferentially spaced thin frangible ribs projecting into said relieved sectors to align the key openings of the tumblers at proper positions for insertion and withdrawal of a key relative to the keyway and to be sheared from said shell member when torque forces exceeding a predetermined threshold value are applied to the tumblers.

* * * * *